US006266948B1

(12) United States Patent
Serra

(10) Patent No.: US 6,266,948 B1
(45) Date of Patent: Jul. 31, 2001

(54) BOX OPENING AND FILLING MACHINE

(75) Inventor: Franco Serra, Bologna (IT)

(73) Assignee: BFB S.p.A., Bologna (IT)

( * ) Notice: Subject to any disclaimer, the term of this patent is extended or adjusted under 35 U.S.C. 154(b) by 0 days.

(21) Appl. No.: 09/331,935

(22) PCT Filed: May 27, 1998

(86) PCT No.: PCT/EP98/03115

§ 371 Date: Jun. 30, 1999

§ 102(e) Date: Jun. 30, 1999

(87) PCT Pub. No.: WO98/57857

PCT Pub. Date: Dec. 23, 1998

(30) Foreign Application Priority Data

Jun. 18, 1997 (IT) ..... BO97A0370

(51) Int. Cl.[7] ..... B65B 5/04; B65B 43/18; B65B 43/30

(52) U.S. Cl. ..... 53/566; 53/252; 53/377.2; 53/377.5; 53/378.3; 493/182; 493/316

(58) Field of Search ..... 53/565, 564, 566, 53/250–252, 377.2, 377.5, 378.3; 493/147, 182, 309, 316, 181, 183

(56) References Cited

U.S. PATENT DOCUMENTS 2,935,918 * 5/1960 Goss ..... 53/564 X
3,486,423 * 12/1969 Mistarz ..... 53/565
4,790,123 * 12/1988 Ljungstrom et al. ..... 53/565
5,509,257 * 4/1996 Tagliaferri et al. ..... 53/566
5,613,828 * 3/1997 Haddow et al. ..... 53/564 X
5,713,187 * 2/1998 Peterson ..... 53/566

FOREIGN PATENT DOCUMENTS

0679578 * 11/1995 (EP) .
0693425 * 1/1996 (EP) .
712783 * 5/1996 (EP) .

* cited by examiner

*Primary Examiner*—Stephen F. Gerrity
(74) *Attorney, Agent, or Firm*—Larson & Taylor PLC

(57) ABSTRACT

The base of the machine consists of three modular casings (1, 2, 3) which are aligned with one another and fixed together and inside which the synchronized systems for the various work stations are arranged. The frames of the parallel and vertical-axis belts (C1, C2) which are designed to convey the boxes (B) with a vertical arrangement are supported cantilever-fashion by the base casings, via upturned portal structures (6). The operating stations of the machine are supported by the frames of the belts or by the base casings, such that the box conveying line is free at the bottom so as to allow better cleaning and better inspection. The middle module (2) inserts the product (V) into the boxes.

19 Claims, 12 Drawing Sheets

BOX OPENING AND FILLING MACHINE

BRIEF DESCRIPTION OF THE INVENTION

The invention relates to a rectilinear box opening and filling machine suitable for processing vertically arranged boxes and consequently usually called a vertical box opening and filling machine. Vertical box opening and filling machines constructed in accordance with the known art have the following technical problems: The boxes are generally arranged in the feed magazine, stacked and oriented with their axis parallel to the longitudinal axis of the box-making machine. This condition results in problems with regard to feeding the boxes into the magazine by means of a stacking conveyor positioned parallel to the longitudinal axis of the box-making machine in order to limit the plan dimensions of the machine, since the boxes themselves would have to rest on this conveyor via their end flaps, which could result in their becoming disarranged or being damaged. The invention aims to overcome this drawback by placing the boxes on the said stacking conveyor, edgeways, on their side walls, transversely and such that the boxes reach the vertical part of the magazine with their longitudinal axis parallel to that of the box-making machine, similar to what happens in horizontal box-making machines. In order to achieve these advantages, special devices have been devised in order to extract the boxes from the magazine, arrange them vertically, unfold them from a rhombus shape and insert them open and undamaged into the pairs of parallel and toothed belts which convey the said boxes and position them in the succeeding work stations of the machine.

A further problem which is encountered in vertical box opening and filling machines of the known type consists in the fact that the frames on which the toothed and parallel box conveying belts travel and the various operating stations of the machine are supported by a base structure which is also positioned partly below the said conveying belts, creating hygiene-related problems since it retains any dirt which falls from the operating line and restricts the possibility of inspecting the said operating stations during the adjustment operations and during ordinary and extraordinary maintenance of the machine. The invention therefore intends to solve this problem with the following solution. The machine is formed by a long base structure in the form of a container inside which the drive systems for the various operating stations are housed. The frames supporting the parallel and toothed belts conveying the boxes themselves are mounted on one side of this structure cantilever-fashion and allow the possibility of performing the adjustments required by a change in shape or size of the boxes. The operating stations of the machine are mounted on these frames and/or on the same side of the base which carries the said frames. In this way the current practice of having a base underneath the box-conveying line is avoided, resulting in the advantages arising from this condition.

In box opening and filling machines of the known type there often exist problems of diversification of the central part assigned for insertion of the product into the boxes. This part of the machine must, if necessary, be prepared so as to introduce first of all, into the boxes, protective ribbed cardboard inserts and to introduce, again before or following insertion of the product, leaflets, any dosing devices or any other means for correct use of the product itself. These various conditions at present require general re-designing of the machine, with the consequent production costs arising therefrom. The invention aims to overcome this drawback with the following solution. The machine is divided up lengthwise into three modules which are fixed one behind another and interconnected with the main drive system. A first module supports the magazine and the means for feeding the boxes to the conveyor belts and supports the stations for closing the bottom flaps of the boxes. The last module supports the means for closing the top flaps of the boxes and unloading the boxes and supports the means for driving the conveying belts. The first and the third modules house, for example, the frames of the box conveying belts. The middle module supports the station(s) for filling the boxes with one or more products. If these stations are to be customized, it is sufficient to modify the central module, while the end modules remain unchanged.

Operating stations for closing the end flaps of the boxes, which are particularly suitable for installation on a modular sectional box opening and filling machine which has a cantilever constructional design of the type mentioned above, have also been devised.

BRIEF DESCRIPTION OF THE DRAWINGS

Further characteristic features of the invention and the advantages arising therefrom will emerge more clearly from the following description of a preferred embodiment thereof, illustrated, purely by way of a non-limiting example, in the figures of the accompanying sheets of drawings, in which.

DETAILED DESCRIPTION OF THE INVENTION

Figure 1:
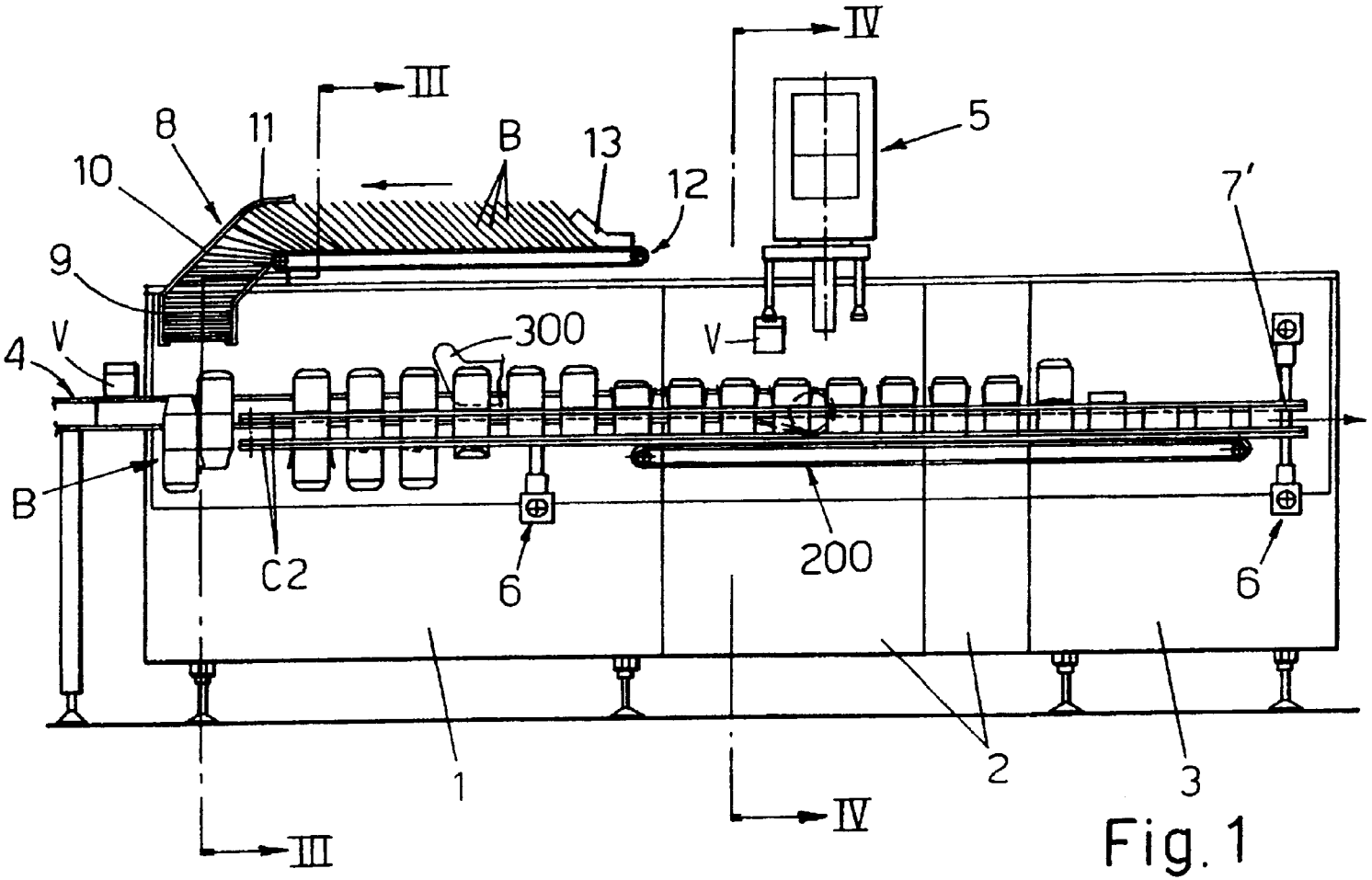
FIGS. 1 and 2 are a side elevation view and top plan view of the machine, respectively.

From FIGS. 1, 2, 3 and 4 it can be seen that the machine according to the invention comprises a base structure consisting of several casings which are aligned and fixed together one after the other, for example at least three casings—indicated by 1, 2 and 3— which have, longitudinally arranged inside them, the main drive shaft with the various branched connections for synchronized driving of the various operating stations of the machine, which are located cantilever-fashion on one side of the said base structure, so that underneath them there are no obstacles preventing cleaning of the machine and restricting the viewing of and access to the various work stations, for the adjustment operations and for ordinary and extraordinary maintenance.

The casing 1 is equipped with the means necessary for feeding the boxes, opening and expanding them and for inserting them, open, in single file and in a vertical arrangement, between the pairs of parallel and toothed conveying belts C1, C2 (see below). The said casing 1 is provided with means for folding and for closing progressively all the bottom flaps of the boxes. The casing 3 is provided with means for folding and closing progressively all the top flaps of the boxes. These means are identical to those associated with the casing 1, except for the fact that they are upside down. The middle box 2 is provided with means which insert, into the boxes, the product together with any protective inserts and any leaflets explaining the characteristics and intended uses of the product. In order to meet particular requirements relating to packaging of the products in the boxes, the middle part of the box-making machine, consisting of the casing 2, may be modified, while the end parts together with the casings 1 and 3 will remain substantially unaltered. From FIGS. 2, 3 and 4 it can be seen that the casings 1, 2 and 3 are aligned along the rear and that the casing 1 has a depth less than that of the casing 3. The middle casing 2 has a Z-shaped configuration of the front side so as to match the different depths of the casings upstream and downstream. The conveyor 4 is arranged in the front lateral recess of the casings 1 and 2, horizontally and parallel with respect to the belts C1, C2, said conveyor removing the products, for example bottles V, from one end of the machine and conveying them in single file into the feed station 5 located on the casing 2, consisting for example of a small vertical-axis rotating carousel provided with grippers or suction means which remove the product from the said conveyor and insert into a corresponding box. We shall not here consider in detail the means associated with the middle casing 2, since they may of any known type.

Figure 4:
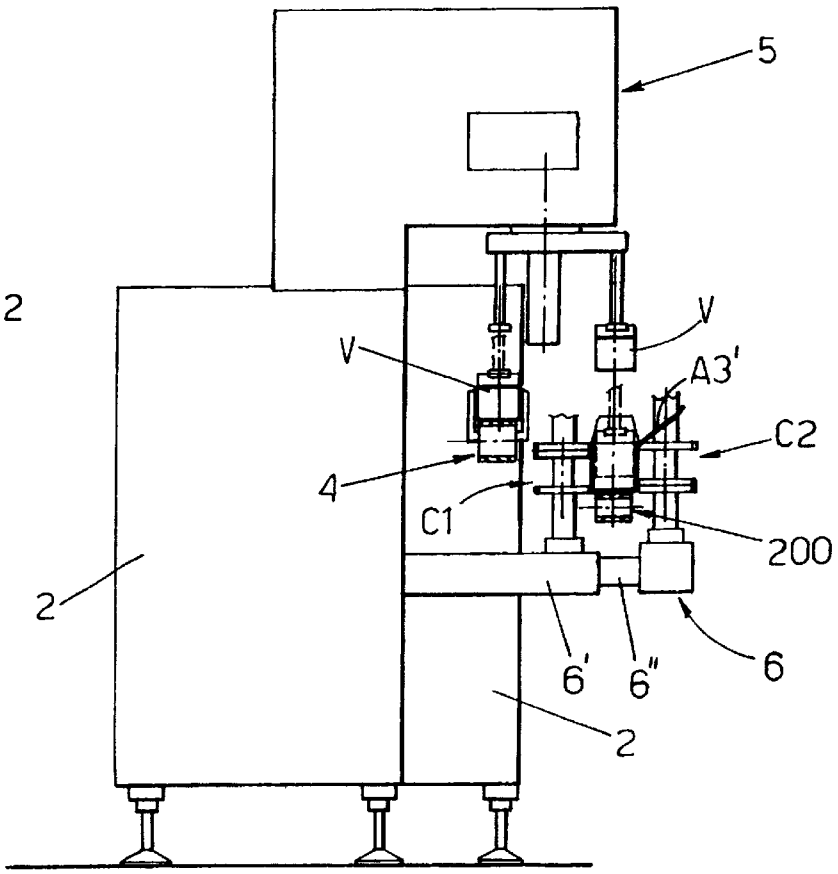
FIGS. 3 and 4 show other details of the machine viewed respectively on the cross-sections III—III and IV—IV of FIG. 1.
Figure 3:
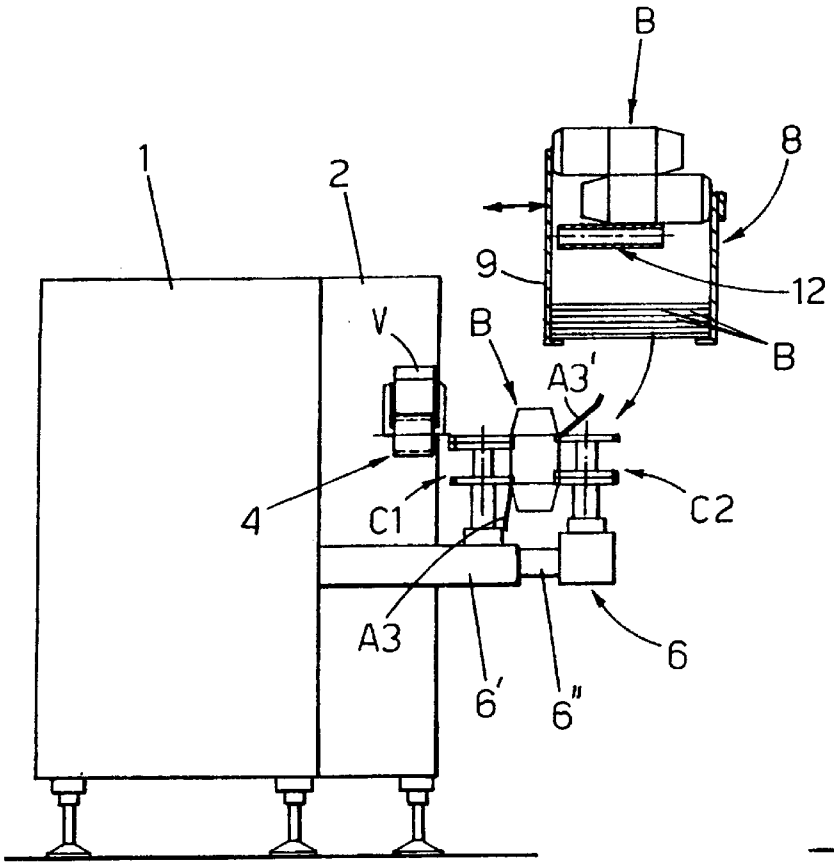

The front side of the casings 1, 2 and 3 have, arranged on them, the parallel and adjustable pairs of toothed belts C1, C2 which are driven at their ends around vertical-axis pulleys provided externally with facing and known teeth which form the seatings of variable dimensions which receive in synchronism the boxes which the belts themselves then transfer with an intermittent movement into the succeeding work stations of the machine. The belts C1 and C2 are mounted on frames supported cantilever-fashion by the casings 1 and 3, via adjustable upturned portal structures 6, and are driven with the ends pulleys 7, 7' by means of partly telescopic shafts and bevel gear pair transmissions, not shown, the ends of which connect with the main machine shaft located longitudinally inside the casings 1, 2 and 3 (see below). The belts C1 located on the same side as the casings 1, 2 and 3 have a fixed position with respect to the said casings and their frame is supported by the fixed parts 6' of the structures 6, while the belts C2 are designed such that their distance from the belts C1 can be adjusted when there is a variation in the shape or size of the boxes, and their frame is supported by the movable parts 6" of the said upturned portal structures 6 (FIGS. 3, 4). In addition to horizontal adjustment, means are also provided for vertical adjustment of the pairs of belts C1, C2, so as to adapt the height of the box seatings to the dimensions of the said boxes to be processed. For this adjustment it is preferably envisaged that the bottom zero position be maintained. The constructional details of the conveying belts and the associated drive and horizontal and vertical adjustment means are not considered here since they may be deduced and easily realized by a person skilled in the art, e.g. on the basis of known solutions.

Figure 6:
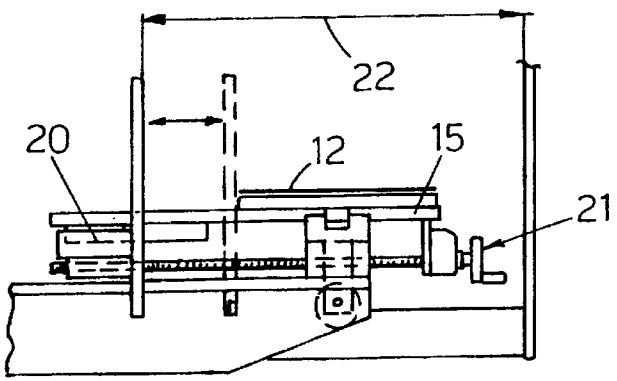
FIGS. 5 and 6 show respectively side and front details of the box feed magazine.
Figure 5:
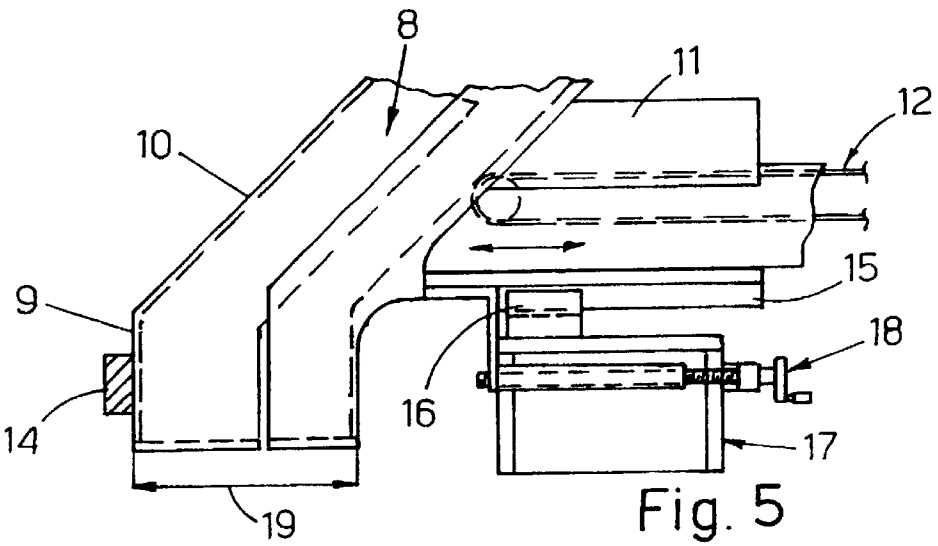

It is understood that the present invention also extends to the variant in which the module 1 and the module 3 are situated respectively on the right and on the left of the module 2, with feeding of the boxes and the product from right to left. According to a further variant, the modules 1, 2 and 3 may have the same depth and the conveyor 4 supplying the product V may be arranged with its end perpendicular with respect to the middle module 2. Within the context of a machine of the aforementioned type with reference to FIGS. 1 to 4, with a cantilever constructional design of the modular and sectional type, or within the context of a machine of known type, the invention aims to overcome the following technical problem: devise a highly reliable solution to ensure that the boxes may be stacked in a feed magazine with their axes at right angles to the longitudinal axis of the machine, similar to what occurs in horizontal box-making machines, such that the boxes themselves may be fed into the magazine by a belt conveyor arranged parallel to the said longitudinal axis of the machine and so that the boxes are able to rest correctly on this conveyor on their side walls and arranged edgewise. These new means must be able to remove the boxes stacked with a horizontal arrangement, orient them vertically, open and expand them, and insert them without relative movements between the conveying belts C1 and C2. Means of this type which also fold the bottom rear flap of the box before a fixed folding device intervenes and folds the bottom front flap onto it are now described. From FIGS. 1, 2, 3, 5 and 6, it can be seen that the box feed magazine 8 comprises a vertical section 9 in which the boxes are arranged horizontally and which, via an inclined upper section 10, is connected to a horizontal section 11 provided longitudinally with a motor-driven belt conveyor 12 on which the flattened boxes are placed with their side walls downmost, transversely oriented, edgewise, with a suitable forwards inclination of the upper side and which, by means of a counterweight 13, are continuously pushed by the conveyor in the direction of the said inclined part and the said last vertical part of the magazine. Considering the direction of forward movement of the boxes, the front walls of the vertical section and of the inclined section of the magazine 8 are mounted on a support 14 integral with the casing 1, while the rear walls of the said magazine sections and the frame of the conveyor 12 are mounted on a slide 15 (FIG. 5) which travels on a horizontal and rectilinear guide 16 fixed to a structure 17 integral with the said casing 1 and which, by means of a screw/female thread system 18, may be adjusted positionwise so as to vary the dimension 19 of the magazine and adapt it to the size or shape of the boxes used. In FIG. 6 it can be seen that the slide 15 is intended to act as a guide for a right-angled slide 20 to which the side of the magazine nearest the casing 1 is fixed and this slide is connected to a screw/female thread adjusting device 21 which allows the width 22 of the magazine to be modified according to the variation in shape or size of the boxes.

Figure 2:
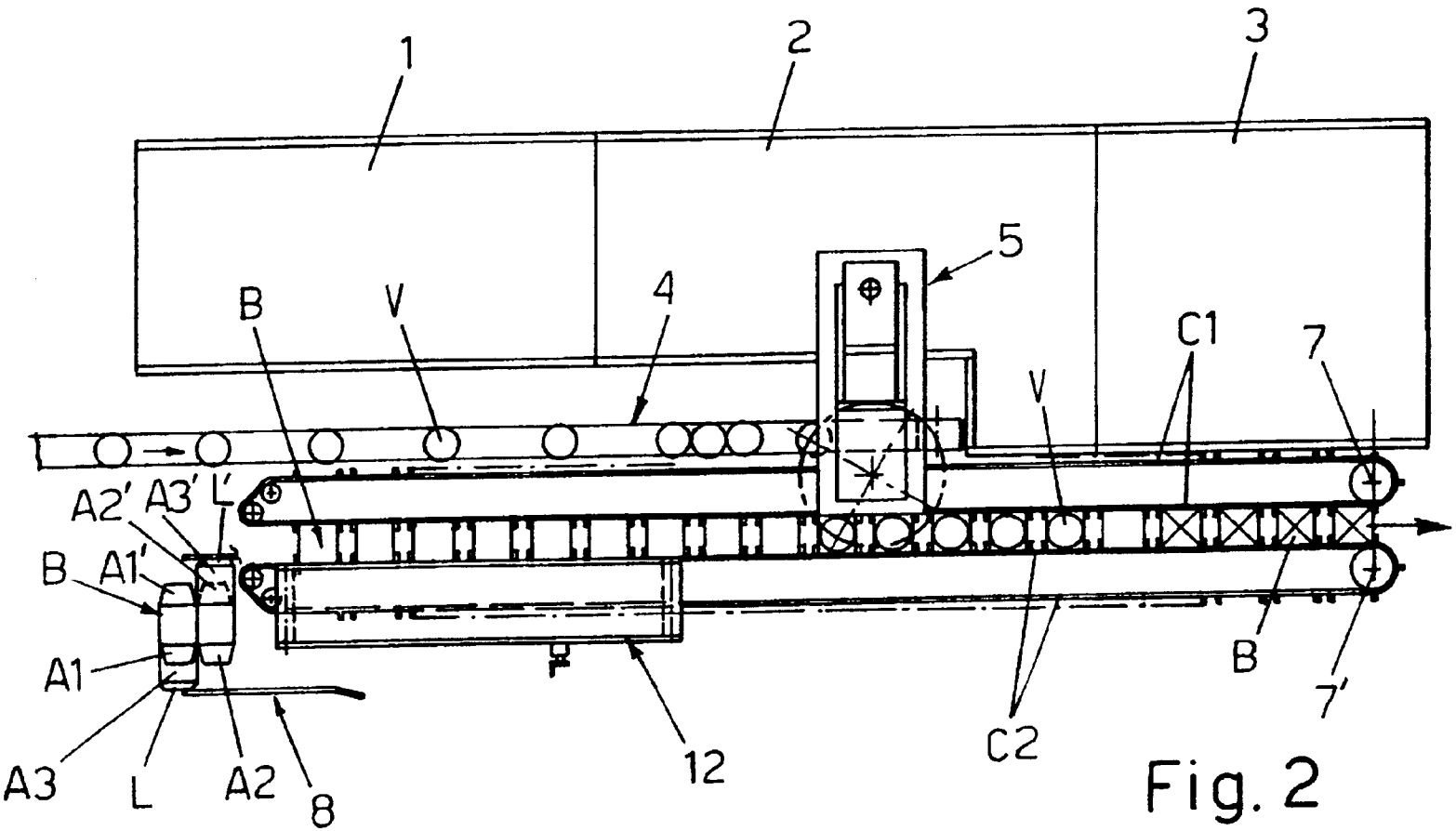

In the example in question, as shown in FIG. 2, the boxes B used are provided at the ends of the side walls with three consecutive flaps, two of which A1–A2 and A1'–A2' are the same and opposite and each close the box partially, while the third flap A3, A3' is such that it closes the box completely and is provided at its end with a tongue L, L' designed to be inserted into the box itself. For this composite configuration, the aforementioned third flap is referred to below as the closing flap.

Figure 7:
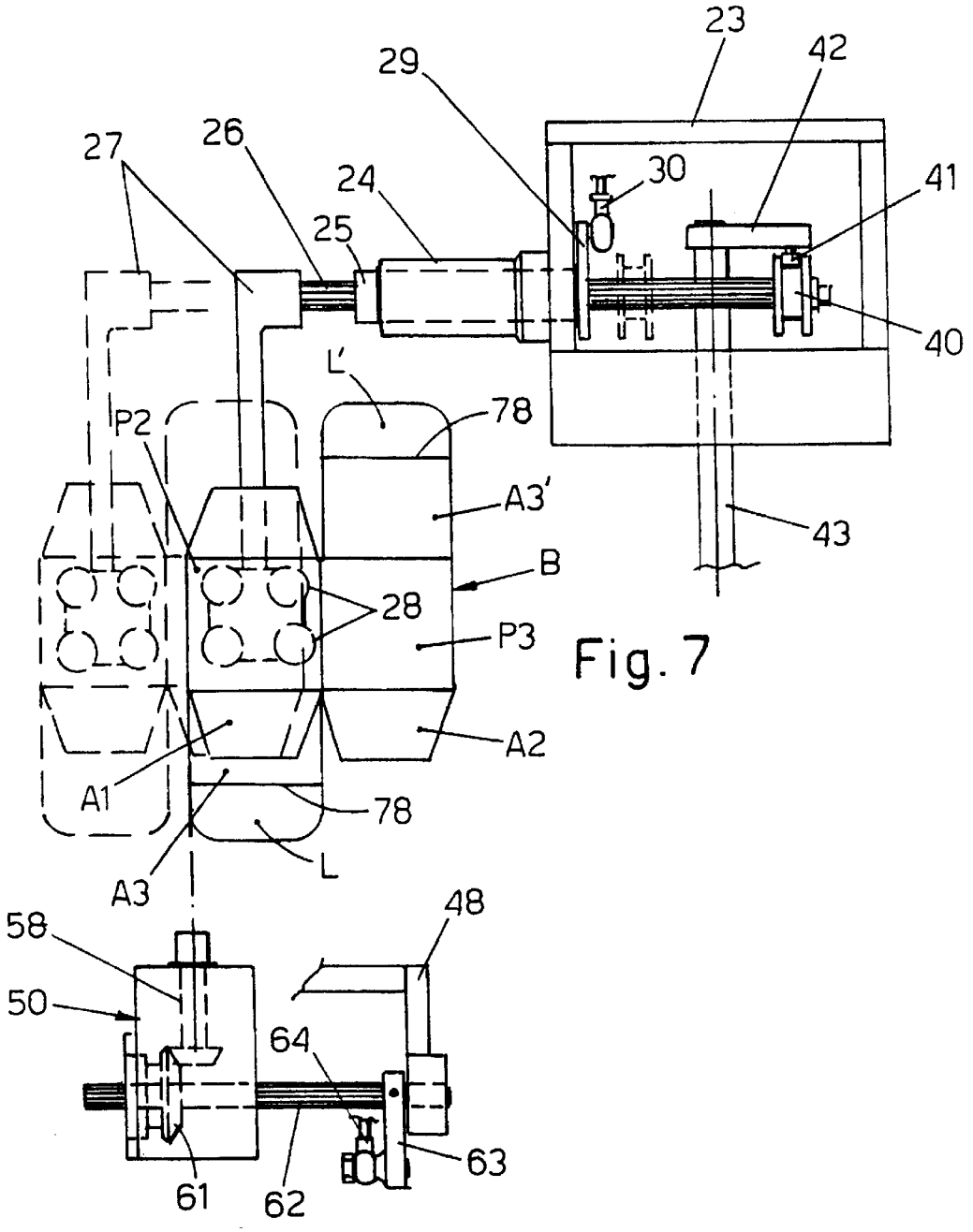
FIGS. 7, 8 and 9 are respectively side, front and perspective views of the station which extracts the boxes from the magazine, opens them and inserts them into the vertical-axis conveying belts.
Figure 8:
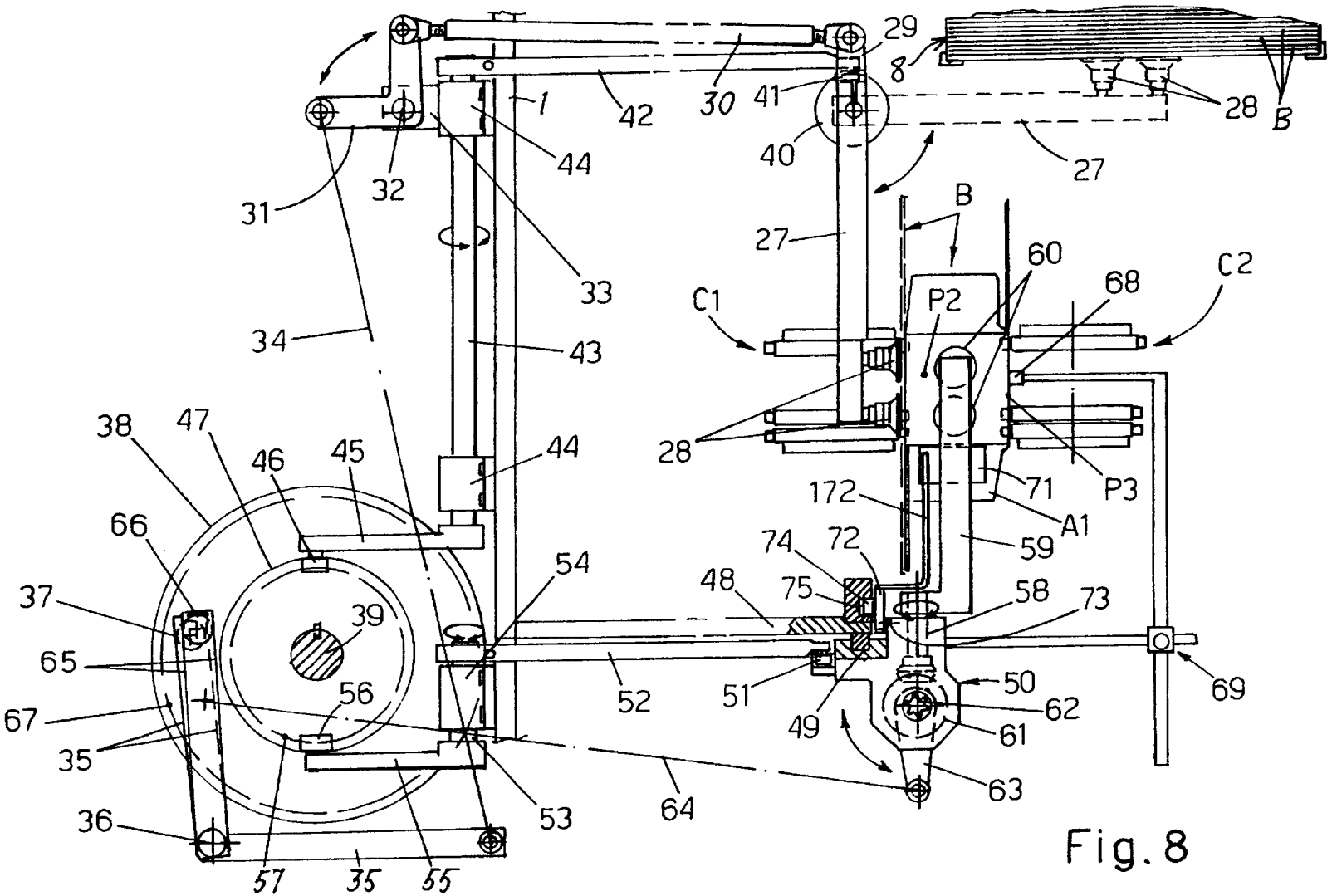

In FIGS. 7 and 8 it can be seen that, laterally with respect to the vertical part 9 of the box magazine, on the side facing the casing 1 there is provided a support structure 23 which is integral with this casing and which has, flanged to it, a horizontal sleeve 24 which is parallel to the longitudinal axis of the machine and inside which a bush 25 is rotatably mounted, the internal surface of said bush being splined and said bush having, sliding axially inside it, a splined shaft 26 which has, fixed perpendicularly on one end, the arm 27 with the suction cups 28 designed to pick up the box from the magazine 8 (see below). One end of the splined bush 25 has, integral with it, a perpendicular lever 29 which is connected via the tie-rod 30 to a right-angled lever 31 hinged at 32, parallel to the said shaft 26, on a support 33 fixed inside the casing 1. A descending tie-rod 34 is hinged to the lever 31 and connected to a right-angled lever 35 which is pivotably mounted in the middle on a fixed fulcrum 36 and with its own end roller 37 co-operates with the double-acting profile of a cam 38 keyed to the main shaft 39 of the machine, which is situated longitudinally inside the aforementioned casings 1, 2 and 3. From this mechanism, the arm 27 receives the movement necessary for picking up with the suction cups 28 the front side wall P1 of the bottom box of the magazine, as illustrated in FIGS. 7 and 8 in broken lines, in order to extract this box from the magazine and arrange it vertically. In order to reduce the travel of the means intended for the subsequent insertion of the open box between the pairs of toothed belts C1, C2 and make the operation of these same means independent of that of the arm 27, it is envisaged that, in synchronism with the ninety-degree oscillation necessary to extract the box from the magazine, the said arm 27 performs a horizontal translation movement in order to move towards the belts C1, C2, as shown in FIG. 7 in broken lines (initial position) and in continuous lines (final position). This movement is brought about by a flanged wheel 40 fixed onto the free end of the shaft 26 and co-operating with the end roller 41 of a lever 42 fixed onto a vertical shaft 43 which is rotatably supported by brackets 44 inside the casing 1 and which on the bottom end carries a lever 45 which, together with the roller 46, follows the double-acting profile of a cam 47 keyed to the aforementioned shaft 39.

Figure 10:
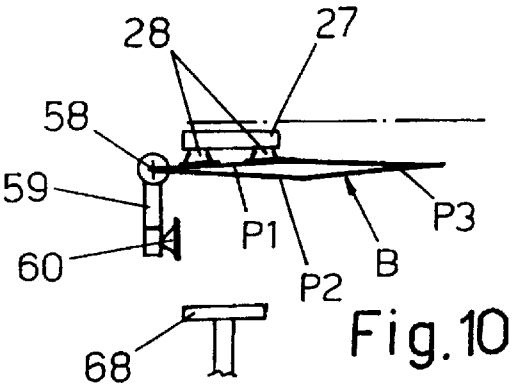
FIGS. 10, 11 and 12 are schematic top plan views of the means which perform so-called unfolding from a rhombus shape or expansion of the boxes.
Figure 11:
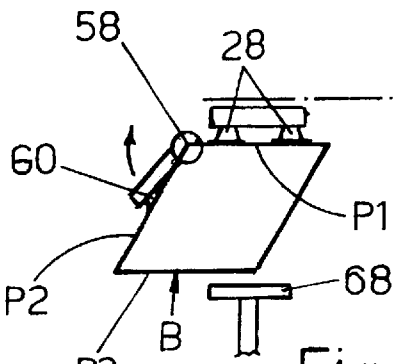
Figure 9:
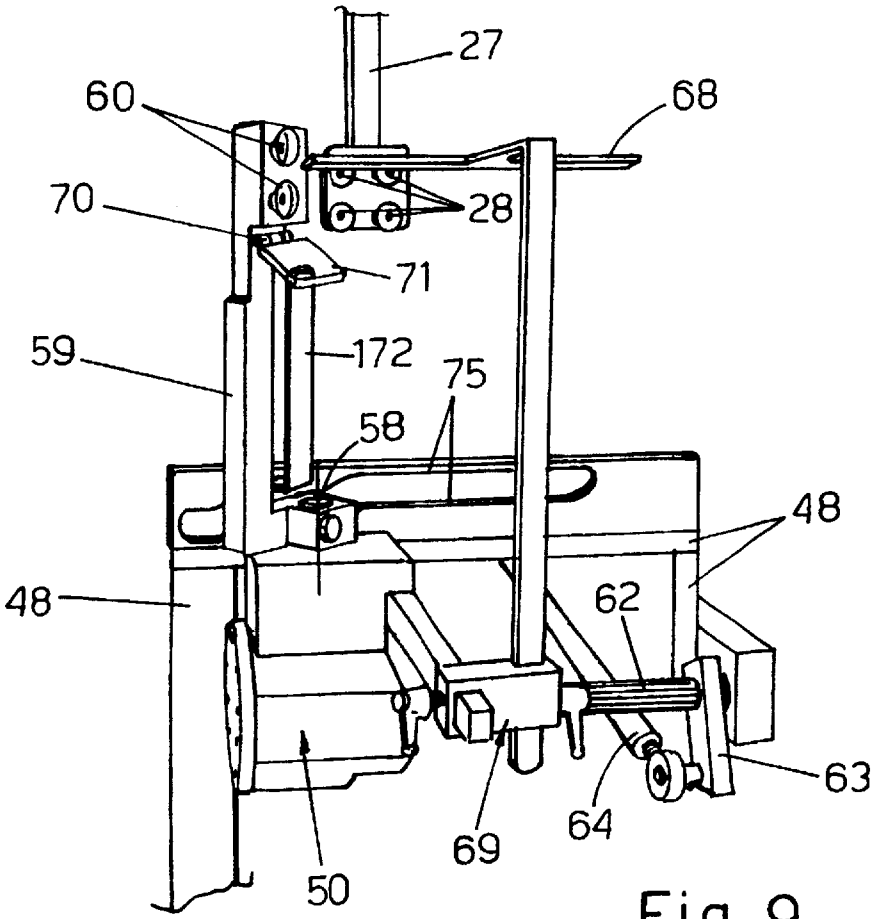
Figure 12:
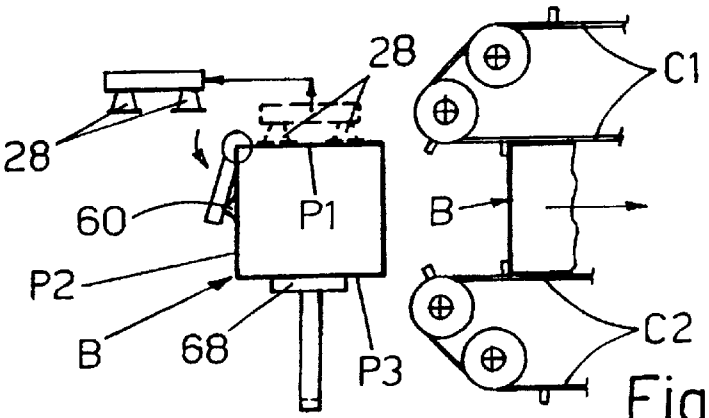

In FIGS. 7, 8 and 9, it can be seen that, underneath the support 23, there is provided an additional support 48 which is integral with the casing 1 and on which a precision slide/guide unit 49, parallel to the said shaft 26, is mounted. The body of an angular drive transmission 50 consisting of a bevel gear pair is fixed on the slide of this unit and the same slide is connected by means of the end articulation 51 to a lever 52 which enters into the casing 1 and which is fixed to a vertical shaft 53 supported rotatably by the support 54 and provided on the other end of a lever 55 which, by means of its roller 56, follows the double-acting profile of a cam 57 keyed to the said drive shaft 39. The vertical drive output shaft 58 of the angular transmission 50 has, keyed to it, the base of an L-shaped arm 59, the shank of which is vertical and carries at the top the suction cups 60 for gripping the side wall of the box following that retained by the suction cups 28 of the extraction unit already considered. The horizontal axis bevel pinion 61 of the angular transmission 50 is provided with an axial cavity which is splined and open towards the outside, for co-operation with a splined shaft 62 (FIG. 7) which is supported rotatably at one end by the support 48 and which on this end carries, fixed, a perpendicular lever 63 which by means of the tie-rod 64 is connected to a lever 65 pivotably mounted on the shaft 36 and which with its end roller 66 follows the double-acting profile of a cam 67 keyed to the main shaft 39. The arm 59 with the suction cups 60 receives from the cam 57 a horizontal translatory movement, while it receives from the cam 67 an oscillating movement of suitable amplitude on the vertical axis 58. At the start of each cycle, the arm 59 is oriented as shown in FIGS. 8 and 10, but is displaced towards the belts C1, C2 so as not to interfere with the box which, in synchronism, is removed from the magazine by the arm 27 and is deposited by the latter vertically. When the arm 27 has extracted the box B from the magazine, with gripping of the wall P1, after the said arm has reached the end of its rotational downwards travel and has moved forwards, the extracted box B is in the condition according to FIG. 10, the retraction of the arm 59 into the rest position having occurred in synchronism. From FIG. 10 it can be seen that the vertical side following the walls P1 and P2 of the box is aligned with the vertical axis of the shaft 58 which carries the arm 59. At this point the shaft 58 causes rotation, in the anti-clockwise direction, of the arm 59 which, with the suction cups 60 active, grips the wall P2 of the box and then the said shaft 58 performs a reverse rotation of amplitude greater than 90°, for example of about 120–150°, as illustrated in FIG. 11, so as to relax the joining zones interconnecting the side walls of the said box, as usually occurs during the so-called process of expansion of the said boxes. In a synchronized sequence the arm 59 returns into the rest position as shown in FIG. 12, with the walls of the box arranged at ninety degrees with respect to one another. The side wall P3 of the box rests against an abutment 68 supported by an adjustable structure 69 which is fixed to the body of the angular transmission 50 (FIG. 9). Once opening of the box has occurred, the arm 27 performs a slight oscillation away from the box and then performs a translatory movement towards the cycle start position as illustrated schematically in FIG. 12, so as to be able to co-operate with the magazine 8 and remove from the latter the next box. The arm 59, in synchronism, moves forward towards the belts C1, C2, at a constant speed which is the same as the linear speed of the said belts, so as to insert the box between the latter without relative movements and release it only after the box has been gripped precisely and securely by the means which follow (see below). Once insertion of the box between the belts C1, C2 has occurred, the suction cups 60 are deactivated and after the arm 27 has extracted another box from the magazine, the arm 59 returns into the rest position for repetition of a new working cycle.

Figure 13:
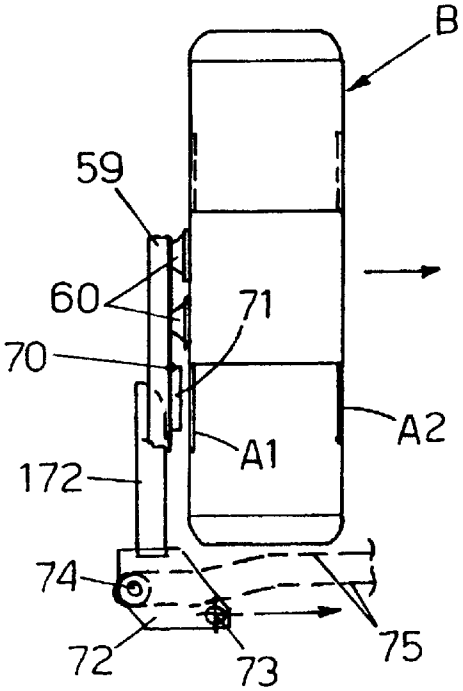
FIGS. 13, 14 and 15 show laterally the unit for expanding the boxes during insertion of a box between the vertical-axis conveying belts and during activation of the means which fold the rear and front end flaps of the box.
Figure 15:
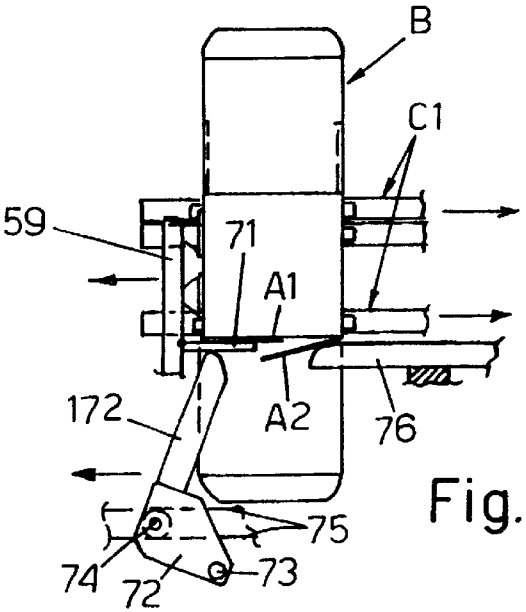
Figure 14:
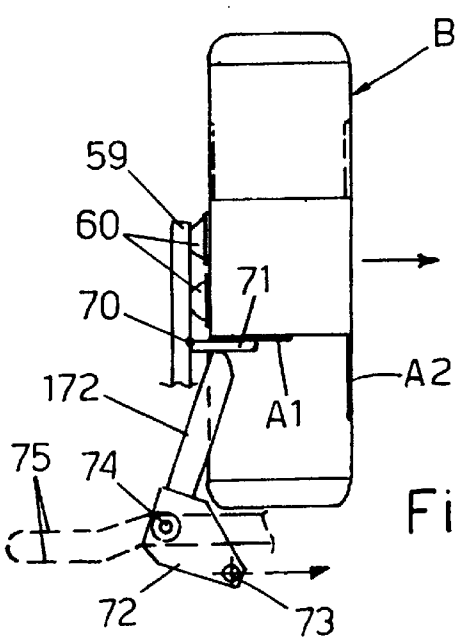

From FIGS. 8, 9 and 13 it can be seen that the arm 59 has, underneath the suction cups 60, an inset step in which there is horizontally hinged at 70 a flap or hinged lug 71 which projects by a suitable amount at least from the side of the said arm 59 which faces the casing 1 (FIG. 8). Behind this projecting part of the hinged lug 71 there is arranged the rounded top end of a finger 172 directed downwards and joined at the bottom end to the end of a lever 72 oriented in the direction of feeding of the boxes and hinged at its front end on a shaft 73 at right angles to the shaft 58 and supported by the body of the angular transmission 50. The lever 72 carries laterally, opposite the finger 172, a roller 74 which follows the grooved profile 75 of a linear cam fixed on the frame 48 and parallel to the splined shaft 62 (FIG. 9). At the start of each cycle (FIG. 13), the hinged lug 71 is oriented downwards. When the arm 59 performs the movement for insertion of the box between the conveying belts C1, C2, as illustrated in FIG. 14, the finger 172 swings forwards and raises the hinged lug 71 by an amount such that the latter raises through ninety degrees the rear bottom flap A1 of the said box B inserted between the said belts. In a synchronized sequence the front bottom flap A2 of the box inserted between the belts C1, C2 and still retained by the arm 59 co-operates with a linear and fixed folding device 76 (FIG. 15) which is located between the said belts and which raises this flap and arranges it on top of the flap A1, supporting both of them. After insertion of the box between the belts C1, C2 and folding of the flaps A1, A2, while the box is continuing to be displaced by the said belts, the moving part which carries the arm 59, together with the suction cups 60 deactivated in synchronism, stops and returns with a reverse movement into the start of cycle position, with the hinged lug 71 repositioning itself in the downwards direction since it has been released by the finger 172.

Figure 21:
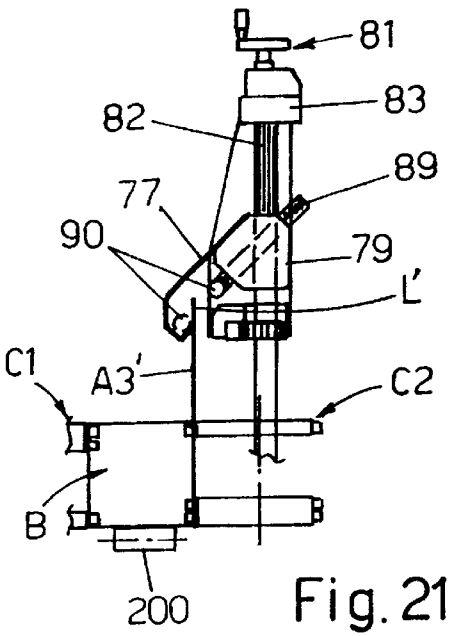
FIG. 21 is a front view of the part of the means according to FIGS. 17 and 20 which pre-folds the top closing tongue of the box.
Figure 20:
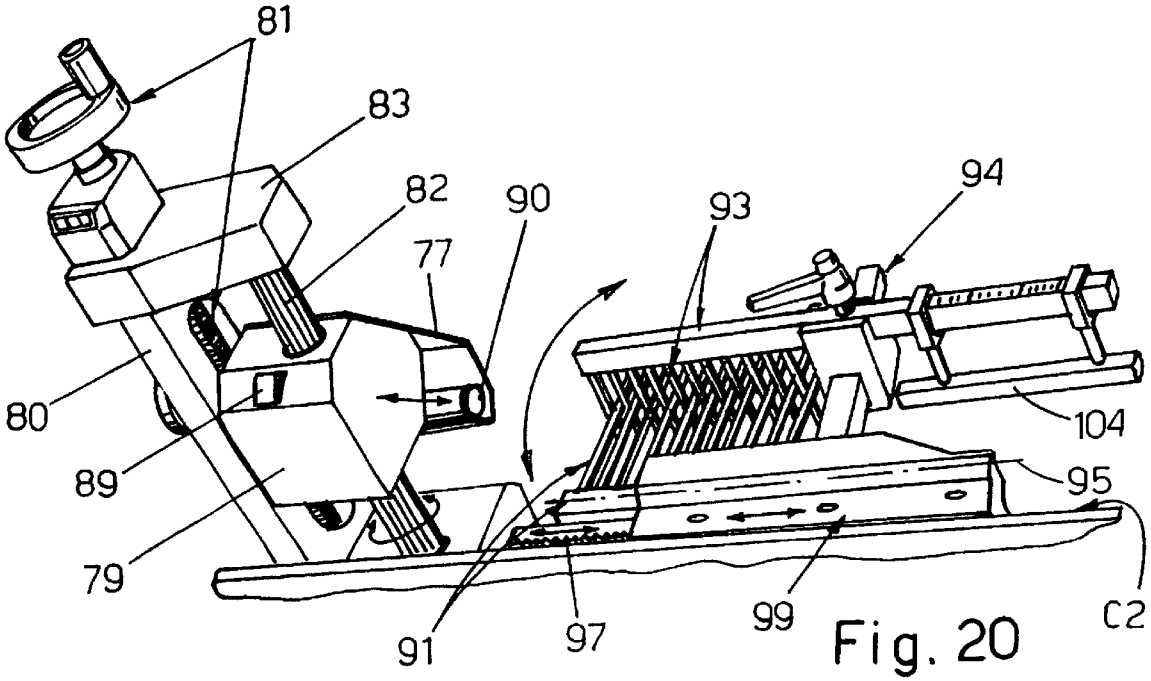
FIG. 20 is a perspective view of the means according to FIG. 17.
Figure 23:
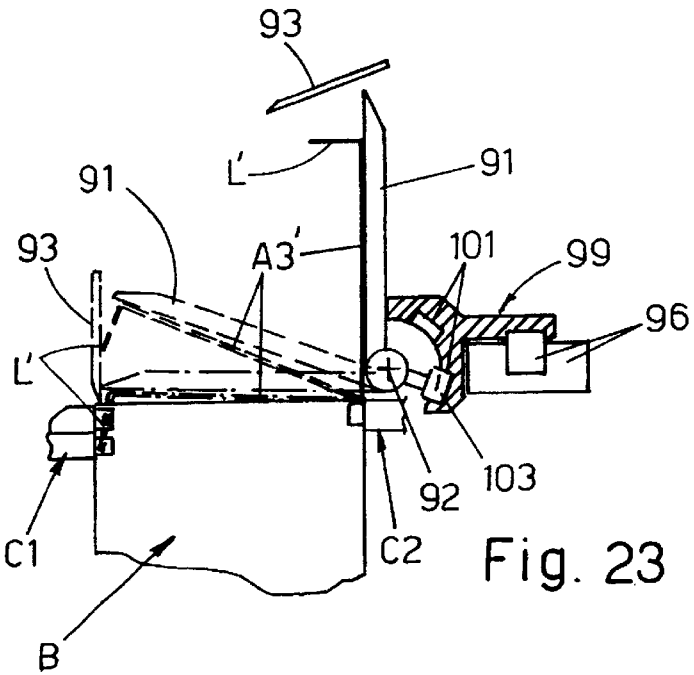
FIGS. 22 and 23 shows details viewed on the sections XXII—XXII and XXIII—XXIII according to FIG. 17.
Figure 22:
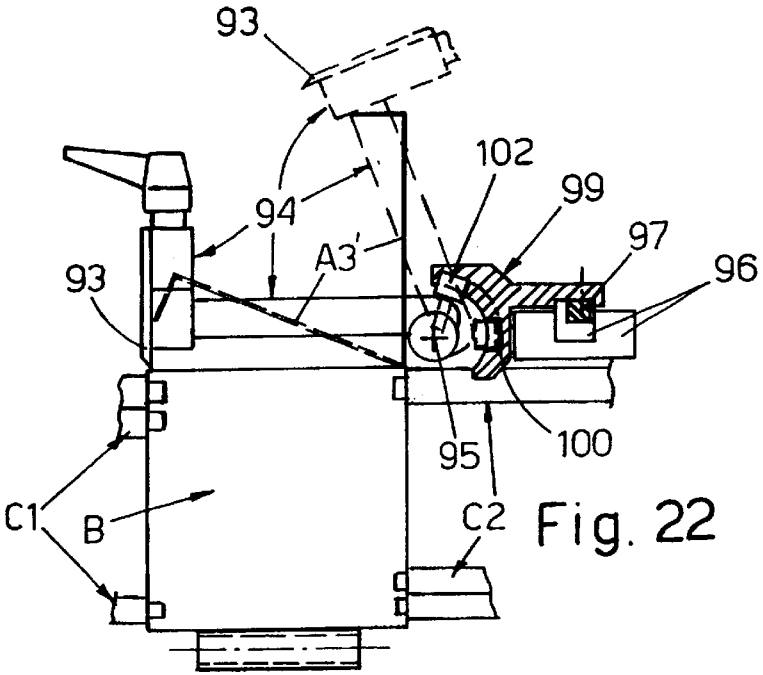

With reference to FIGS. 17, 20, 21, 22, 23 and 24 the means which fold the tongue and which fold the bottom closing flap A3 of the box are now described. Since these means are identical to those which act on the corresponding top flap A3' of the box, for the sake of simplicity these latter means will be described. In FIG. 21 it can be seen that, during the intermittent feeding movement of the belts C1, C2, the boxes arrive cyclically with the closing flap A3' correctly oriented by prior guiding means, not shown, in front of the edge of a hooked structure 77. The heightwise position of this structure must be able to be adjusted so that its edge touches exactly the joining line 78 which connects the flap A3' to the corresponding tongue L' (see also FIG. 7) designed to be inserted into the box (see below). For this purpose, the said structure 77 is fixed to a slide 79 which travels on a vertical guide 80 which is fixed for example to the support frame of the belts C2 and the position of which may adjusted heightwise by means of the screw/female thread unit 81. The guide 80 supports rotatably and parallel thereto, partly by means of the projection 83, a splined shaft 82 which is connected to an angular transmission 84, the horizontal shaft of which enters the nearby base casing of the machine where it has, keyed on it, a gear wheel 85 which meshes with a gear wheel 86 of larger diameter provided in an eccentric position with a roller 87 which follows the double-acting profile of a cam 88 keyed to the drive shaft 39, so that the said splined shaft is made to perform an oscillating movement in synchronism with the various operating parts of the machine. The slide 79 has an inclined channel inside which slides a rack 89 which is parallel to the body of the structure 77 and which with its inclined teeth meshes with the splined shaft 82, so as to receive from the latter reciprocating rectilinear movement. The rack 89 has, fixed transversely at the end and in the middle, a round-sectioned cross-piece 90 which can be operated so as to be inserted into the hook of the structure 77, as illustrated in FIG. 20, in order to fold the tongue L' through about 90° with respect to the closing flap A3', after which the said cross-piece returns into the rest position.

Figure 24:
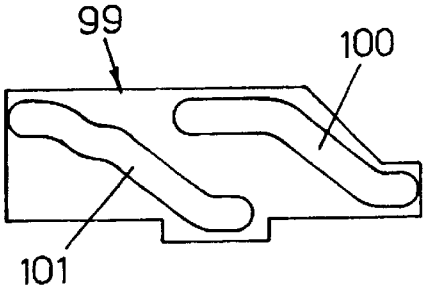
FIG. 24 is a side view of the cam which actuates the means according to FIGS. 22 and 23.

During the subsequent advancing movement by one step, the box B is positioned laterally with respect to a first comb 91 (FIGS. 17 and 23) which originally is oriented upwards and which is able to oscillate about an axis 92 parallel to the conveying section of the belts C1, C2 and supported by the frame which guides the belts C2 and which therefore is located laterally with respect to the flap A3'. The teeth of the comb 91 receive, arranged between them so as to form an angle of less than 90° and so as to project towards the box, the teeth of a second comb 93 which is supported with the possibility of adjustment of the distance from the axis 92, if the shape or size of the boxes varies, by a structure 94 which is able to oscillate about an axis 95 which is aligned with and situated after that 92 mentioned above. The combs 91 and 93 swing initially downwards substantially at the same time and the comb 93 stops when it reaches a vertical position as indicated by the broken line in FIG. 23, with its ends inserted slightly inside the box. In order to ensure this condition, the teeth of the comb 93 terminate in a bottom tip which is profiled at a receiving angle towards the outside of the box. When the comb 93 reaches the said vertical position, it stops and the downward movement of the comb 91 continues, pushing the flap A3' into the closed position and forcing the tongue L' to travel along the teeth of the comb 93 and enter firmly into the box, as indicated by the broken line and dot-dash line in FIG. 23. The combs 91 and 93 then return into the rest position in order to repeat the work cycle. From FIGS. 20, 22 and 23 it can be seen that, laterally with respect to the hinging points 92 and 95 of the combs, on the same frame which supports these hinging points there is mounted, parallel to the latter, a precision slide/guide unit 96 and the slide of this unit is connected to a horizontal rack 97 which meshes with a pinion 98 (FIG. 17) keyed to the splined shaft 82, so as to receive from the latter a rectilinear reciprocating movement in synchronism with the various operating components of the machine. The same slide of the unit 96 (FIGS. 22, 23) has, fixed to it, a cam 99 which has a working part with an arched profile, in the form of a segment of a circle, with the concavity directed towards the hinging axes 92, 95 of the combs and with the centre of curvature located on these same hinging axes. This cam segment is provided with grooves 100 and 101 with a Z-shaped configuration as can be seen in FIG. 24, the profile of which is followed by respective rollers 102 and 103 mounted on pins which are radially fixed on the hinging axes 95 and 92 of the combs themselves which thus obtain the necessary oscillating movement from the reciprocating rectilinear movement of the rack 97 and parts associated with it.

From FIG. 20 it can be seen that the adjustable structure 94 which supports the comb 93 has, mounted on it, behind this comb, a pressing device 104 which has the function of closing completely the flap A3', with complete insertion of the tongue L' into the box, since this operation cannot be satisfactorily performed by the aforementioned combs.

With means similar to those described, but inverted and mounted on the support frame of the belts C1 or on the nearby base casing 1, the flap A3-L closing the bottom of the boxes inserted between the belts C1, C2 is folded. During the folding of the bottom closing flap A3-L, the corresponding top closing flap A3'–L' of each box is moving with its inside face close to the joining line with the box itself, on fixed guiding and opposing means—schematically indicated by 300 in FIG. 1—which prevent unwanted movements of the boxes.

Figure 16:
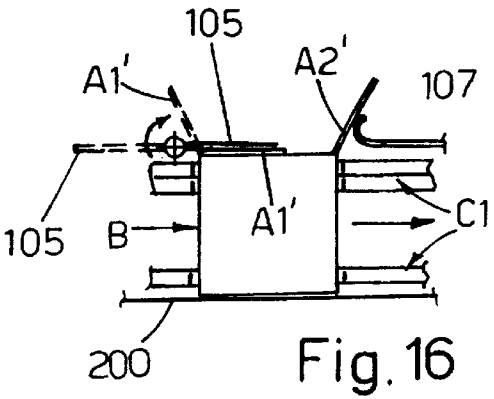
FIG. 16 is a side view of the means which fold the rear top flap of the boxes.
Figure 18:
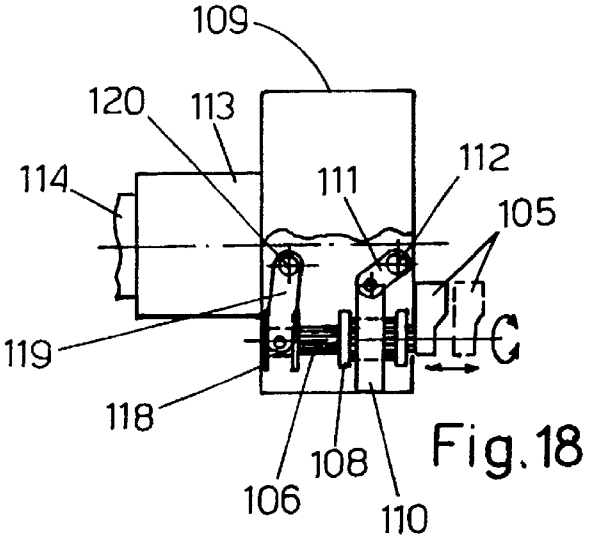
FIG. 18 is a top plan view with sectioned parts of the operating mechanisms of the means according to FIG. 16.
Figure 19:
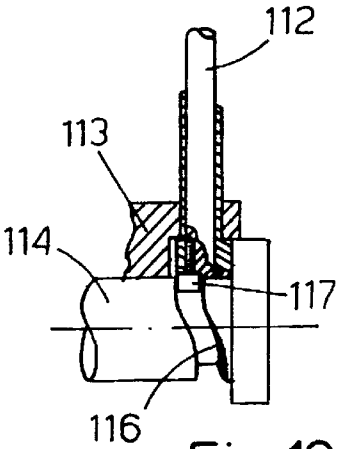
FIG. 19 shows details viewed on the cross-sectional plane XIX—XIX according to FIG. 17.
Figure 17:
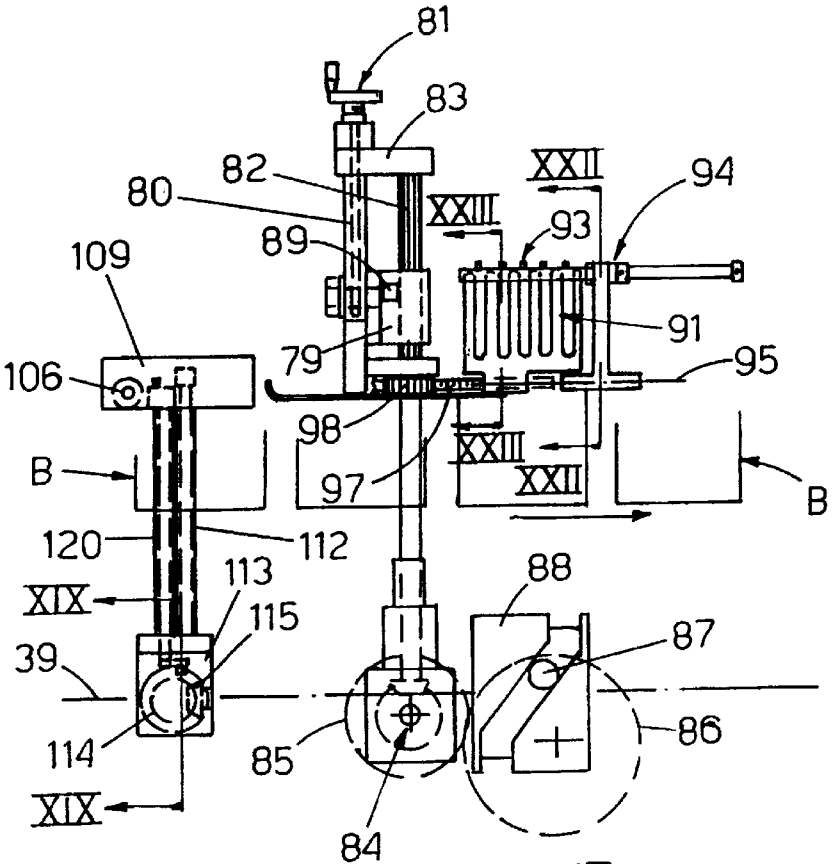
FIG. 17 is a side view of the means according to FIG. 16 and the means for folding the tongue and for folding the top closing flap of the boxes.

From FIGS. 1 and 4 it can be seen that, before reaching the middle part of the machine, for co-operation with the filling station 5, the boxes closed at the bottom rest on a horizontal conveyor 200 which is driven at the same speed as the belts C1, C2 and which supports the boxes themselves until they are is unloaded from the machine. At the exit point of the boxes from the filling station, in the end part of the casing 2 or in the initial part of the casing 3 means are provided to fold in succession the rear top flap A1', the front top flat A2' and finally the already considered closing flap A3'–L'. With reference to FIGS. 16–18 it can be seen that, laterally with respect to the path of the boxes, on the opposite side to the closing flap A3', a blade or hinged lug 105 fixed on a horizontal shaft 106 and perpendicular to the path of the boxes is provided on the frame which supports the conveying belts C1. When the belts C1 and C2 are active, the hinged lug 105 is retracted laterally with respect to the path of the boxes and is oriented horizontally in the opposite direction to the direction of feeding of the said boxes, as shown in FIG. 16 by broken lines. When the belts C1, C2 have been stopped, the shaft 106 extends towards the boxes, positions the hinged lug 105 behind the flap A1' of the nearby box and then rotates through 180° in a clockwise direction when viewing FIG. 16, so as to fold the said flap. The hinged lug remains temporarily active when the belts C1, C2 start the next movement of one step, so as to keep the flap A1' low and allow folding, onto the latter, of the front flap A2' by a fixed folding device 107 (FIG. 16), following which the said hinged lug performs in synchronism the return movements into the rest condition so as not to interfere with the following box which is moving forwards. From FIG. 18 it can be seen that the shaft 106 consists of a splined shaft which engages with an internally splined bush 108 rotatably supported in the fixed container 109 and this bush is externally toothed and meshes tangentially with a rack 110 hinged to a lever 111 keyed to the end of a first vertical and descending shaft 112 which, at its bottom end, enters into a housing 113 which is fixed to the casing 3 and which rotatably supports the said shaft and which is situated substantially at the height of the drive shaft 39 (FIGS. 17, 19). The housing 113 has, rotatably mounted inside it, the end of a horizontal shaft 114 which is perpendicular to the shaft 39 and is connected to it by means of a bevel gear pair 115. The shaft 114 is provided with helical grooves on the end located inside the housing 113 and a roller 117 fixed eccentrically on the bottom end of the shaft 112 engages in one of these grooves 116, so as to transmit to the said shaft the oscillating movement necessary for operation of the rack 110 and so as to transmit to the hinged lug 105 the necessary swinging movement. The axial displacement of the hinged lug 105, on the other hand, is obtained by means of a flanged wheel 118 which is fixed onto the shaft 106 and is engaged by the end roller of a lever 119 keyed to the end of a vertical descending shaft 120 (FIG. 18) which enters the container 113 (FIG. 19) and which is also provided with an eccentric roller for tracing the profile of a helical groove on the shaft 114, similar to that 116 already mentioned for the shaft 112.

What is claimed is:

1. (1+3) A rectilinear box opening and filling machine for processing vertically arranged boxes, comprising:

a modular base having a plurality of operating stations;

a main shaft longitudinally arranged inside of said modular base by which said operating stations operate;

a plurality of upturned portal stations cantilevered to one side of said modular base;

a vertical belt conveyor including a) proximal and distal pairs of parallel, vertical-axis, toothed belts which convey a vertically arranged box therebetween, and b) proximal and distal horizontal belt-support frames which are attached to said plurality of portal stations and which respectively support said proximal and distal pairs of toothed belts;

wherein at least one of said operating stations is supported by one of said belt-support frames such that underneath of all of said belt-support frames an unoccupied space is provided which allows for a fast removal of dirt which falls from above said belt-support frames and which allows accessibility to said at least one of said operating stations, said toothed belts, and said belt-support frames;

wherein each said upturned portal structure includes a) a fixed part fixed to the one side of the modular base, said fixed part supporting said proximal belt-support frame and including a guide member, b) a horizontally movable part having a guided portion movably received in said guide member, said movable part supporting said distal belt-support frame, and c) a distal frame adjusting device which adjusts an extent of said guided portion received in said guide member and hence a position of said distal belt-support frame from said proximal belt-support frame so that boxes of different sizes are suitably received between said proximal and distal pairs of toothed belts; and wherein said belt conveyor includes, supported on one of said upturned portals located at an end part of said belt conveyor, a) a proximal drive shaft connected to said main shaft and a distal drive shaft partly telescopic with said proximal drive shaft, b) proximal and distal transmission bevel gear pairs connected respectively to said proximal and distal drive shafts, and c) proximal and distal end pulleys for said proximal and distal pairs of toothed belts connected respectively to said proximal and distal gear pairs such that said proximal and distal pairs of toothed belts are driven with a complementary reverse rotation and a same speed.

2. (2) A rectilinear box opening and filling machine as claimed in claim 1:

wherein said modular base has first, second and third module casings which are arranged one after another and fixed together;

wherein said first casing includes a) a magazine which feeds the boxes individually, and b) a first closing means for receiving each box from said magazine and for closing bottom flaps of each box;

wherein said second casing includes an insertion means for inserting a product into an open top of each box; and wherein said third casing includes a second closing means for closing top flaps of each box.

3. (4) A rectilinear box opening and filling machine as claimed in claim 2:

wherein said first, second and third casings have a rear and a depth, a) said rears of said first, second and third casing being aligned, b) said depth of said first casing is less than the depth of said third casing, c) said depth of said has a first portion which matches the depth of said first casing and together form an initial inset section of said one side of said modular base, and a second portion which matches the depth of said third casing;

further including a product conveyor conveying product to be packaged in said boxes to said second casing, said product conveyor a) being located in the initial inset section, b) being parallel to said belt conveyor, c) being supported b said first and second casings, and d) being driven by said main shaft.

4. (19) A rectilinear box opening and filling machine as claimed in claim 2:

wherein said box conveyor further includes an intermediate belt on which a closed bottom of each box rests, said intermediate belt a) being disposed below and between said proximal and distal toothed belts, b) beginning after said first closing means and extending past said second closing means, c) traveling at a same speed and direction as said toothed belts.

5. (1+2+6) A rectilinear box opening and filling machine for processing vertically arranged boxes, comprising:

a modular base having a plurality of operating stations;

a main shaft longitudinally arranged inside of said modular base by which said operating stations operate;

a plurality of upturned portal stations cantilevered to one side of said modular base, said one side defining proximal and distal relationships;

a vertical belt conveyor including a) proximal and distal pairs of parallel, vertical-axis, toothed belts which convey a vertically arranged box therebetween, and b) proximal and distal horizontal belt-support frames which are attached to said plurality of portal stations and which respectively support said proximal and distal pairs of toothed belts;

wherein at least one of said operating stations is supported by one of said belt-support frames such that underneath of all of said belt-support frames an unoccupied space is provided which allows for a fast removal of dirt which falls from above said belt-support frames and which allows accessibility to said at least one of said operating stations, said toothed belts, and said belt-support frames;

wherein said modular base has first, second and third module casings which are arranged one after another and fixed together;

wherein said first casing includes a) a magazine which feeds the boxes individually, and b) a first closing means and for closing bottom flaps of each box received from said magazine;

wherein said second casing includes an insertion means for inserting a product into an open top of each box;

wherein said third casing includes a second closing means for closing top flaps of each box;

a horizontal belt conveyor on which flattened boxes transversely rest on sides walls and which flattened boxes are inclined with an upper part forward, said horizontal belt conveyor conveying the boxes towards said magazine and a) being driven by said main shaft, b) being located laterally with respect to said first casing, c) being located above and parallel to an initial part of said vertical belt conveyor, d) having movable proximal and distal retaining lateral side shoulders between which the flattened boxes are constrained, and e) including a ballast weight which pushes the flattened boxes forward through said lateral side shoulders and towards said magazine;

wherein said magazine includes a) an inclined section receiving inclined boxes from an end of said horizontal belt conveyor and turning the boxes horizontally, b) a vertical section leading from said inclined section to a magazine bottom, said vertical section receiving the horizontal boxes from said inclined section and presenting a lowermost horizontal box at the magazine bottom with boxes thereabove arranged flat on top of one another and with longitudinal axes thereof oriented at right angles to a direction of travel of said vertical box conveyor;

c) wherein said inclined section and said vertical section include a movable rear magazine wall adjacent said horizontal belt conveyor and a stationary front wall opposite thereto, and d) wherein said inclined section and said vertical section include a movable proximal side magazine wall adjacent said first casing and a stationary distal side wall opposite thereto; and a mounting structure for said magazine and said movable lateral side shoulders, said mounting structure including a) a bracket cantilevered to said first casing which supports said stationary front wall and said stationary distal side wall of said magazine, b) a first movable slide which is parallel to said horizontal belt conveyor and which supports said retaining side shoulders of said horizontal belt conveyor and said movable magazine walls of said magazine, c) a guide cantilevered to said first casing on which said movable slide is mounted for movement, d) a first adjusting means for adjusting a distance of said rear magazine wall and of said lateral side shoulders from said front wall of said magazine such that flattened boxes of different longitudinal sizes are accommodated therebetween, e) a second movable slide which is mounted to said first movable slide for movement at right angles thereto and to which said movable proximal side magazine wall and said proximal lateral side shoulder are mounted, and f) a second adjustment means for adjusting a distance of said proximal side magazine wall and said proximal lateral side shoulder relative to said distal side magazine wall and said distal lateral side shoulder such that flattened boxes of different lateral sizes are accommodated therebetween.

6. (7) A rectilinear box opening and filling machine as claimed in claim 5, further including:

an extraction mechanism which extracts the lowermost box from said magazine, said extraction mechanism including a) a horizontal shaft extending parallel to the longitudinal axis of said main shaft and mounted to said first casing for 90° rotational movement between an extraction position and a delivery position, b) a first rotation means driven by said main shaft for moving said horizontal shaft between said extraction position and said delivery position, and c) an extraction arm located laterally with respect to said vertical section of said magazine toward said first casing, said extraction arm having a proximal end mounted to said horizontal shaft and a distal end including suction cups such that (i) when said horizontal shaft is rotated to the extraction position said suction cups engage a first side wall of the lowermost box horizontally located in said magazine and (ii) when said horizontal shaft is rotated to the delivery position the lowermost box is extracted from said magazine and said first side wall is located in a vertical plane and distal from a second side wall of the box adjacent thereto and the first side wall is positioned at a height of said proximal pairs of toothed belts for reception thereby;

an opening mechanism which opens the flattened box held by said extraction arm when said horizontal shaft is in the delivery position, said opening mechanism including a) an opening arm mounted at a first end for rotation about a vertical axis aligned with a joining line of the first and second side walls of the box, said opening arm having a second end provided with suction cups at a level of the second side wall, b) a second rotation means driven by said main shaft for rotating said opening arm between a closed position where said suction cups of said opening arm engage the second side of the flattened box held by said extraction arm in the delivery position and an opened position where the second side wall is moved away from the first side wall about the joining line thereof to open the box, and c) a translation means mounted to said first casing for moving, when the extraction arm is moved away from the delivery position, the first end of the opening arm and hence the opened box engaged by said opening arm towards and into said horizontal belt conveyor.

7. (8) A rectilinear box opening and filling machine as claimed in claim 6, wherein said extraction mechanism further includes a second translation means for moving said horizontal shaft synchronously with the moving thereof by said first rotation means between (i) a retracted position when said horizontal shaft is in the extraction position and (ii) an extended position horizontally closer to said vertical belt conveyor and in position for the flattened box to be engaged by said opening arm when said horizontal shaft is in the delivery position, such that once the flattened box is opened by said opening mechanism said second translation means and said first rotation means are actuated to move said extraction arm back to the extraction position independent of the first-mentioned translation means.

8. (9) A rectilinear box opening and filling machine as claimed in claim 7:

wherein said extraction arm fixed to a first end of said horizontal shaft;

wherein said horizontal shaft is splined;

wherein said first rotation means includes a) a splined bush inside of which said splined horizontal shaft axially slides, b) a fixed sleeve inside of which said splined bush is rotatably supported, c) a first lever provided integrally with a second end of said splined shaft, d) a tie-rod having a first end connected to said first lever and a second end, e) a linkage mechanism located in said first casing and having a first end connected to said second end of said tie-rod and a second end, and f) a cam keyed to said main shaft and connected to said second end of said linkage mechanism, whereby the rotational movement is provided to said horizontal shaft; and wherein said second translation means includes a) a flanged wheel integrally connected to a second end of said horizontal splined shaft and having a raceway, b) a second lever having an end roller received in said raceway of said flanged wheel and an opposite end, c) a vertical shaft rotatably located in said first casing having a first end to which said opposite end of said second lever is connected and a second end, d) a third lever having a first end connected to said second end of said vertical shaft and a second end having a cam roller, and e) a cam keyed to said main shaft which said cam roller of said third lever follows.

9. (10) A rectilinear box opening and filling machine as claimed in claim 6:

wherein said opening arm is L-shaped;

wherein said translation means includes a) a bevel gear pair transmission having a vertical output shaft to which said first end of said opening arm is connected and a housing, b) a slide/guide unit having (i) a horizontal slide to which said housing of said bevel gear pair transmission is fixed and which is oriented parallel to the path of said toothed belts and (ii) a guide, c) a support structure fixed to said first casing and to which said slide/guide unit is fixed, d) a vertical-axis hinged articulation to which an end of said guide is connected, e) a first lever to which said hinged articulation is connected and which enters said first casing, f) a rotating vertical shaft located in said first casing and to which said first lever is connected, g) a second lever to which said rotating vertical shaft is connected and having an end roller, and h) a first cam keyed to said main shaft in which said end roller of said second lever is received such that said slide is moved horizontally and hence said opening arm is moved towards and away from said horizontal belt conveyor; and wherein said second rotation means includes a) a horizontal-axis bevel pinion in said bevel gear pair transmission which is axially hollow, splined and open towards an outside, b) a horizontal and splined shaft which is engaged in said horizontal-axis bevel pinion and which is supported at one end by said support structure, c) a third lever fixed perpendicularly to said splined shaft, d) a tie-rod fixed to said third lever, e) a fourth lever which is connected to said tie-rod, which is located inside of said first casing, and which has a roller, and f) a second cam keyed to said main shaft in which said end roller of said fourth lever is received such that said opening arm is rotated.

10. (11) A rectilinear box opening and filling machine as claimed in claim 9:

wherein said translation means includes a support piece adjustably mounted to said slide to cooperate with an third side wall opposite to the first side wall of an opened box such that during movement of said opening arm towards said horizontal belt conveyor the box is supported in a squared-up configuration.

11. (12) A rectilinear box opening and filling machine as claimed in claim 10:

wherein said first closing means includes a) an inset step below said suction cups of said opening arm, b) a lug hinged to said opening arm at said inset step for rotation about a horizontal axis, c) a finger having a rounded end which normally supports said lug such that said lug is in a vertical position oriented downwardly but projecting laterally somewhat away from said first casing, d) a fifth lever to which a bottom end of said finger is integral, said lever being hinged to said housing of said bevel gear pair transmission with a horizontal articulation at right angles to a moving axis of said translation means, said fifth lever also including a roller, e) a linear and fixed cam which is engaged by said roller of said fifth lever such that when said opening arm moves the opened box towards said horizontal belt conveyor said finger swings away from first casing causing said lug to rise and to move a bottom rear flap of the opened box to a closed position; and wherein said first closing means further includes a) a fixed folding device which raises a bottom front flap of the opened box to a closed position in engagement with the closed bottom front flap so that said opening arm then releases the opened box.

12. (20) A rectilinear box opening and filling machine as claimed in claim 11:

wherein said second closing means includes a) a hinged lug at one of an end of said second casing or a beginning of said third casing, b) a second horizontal shaft which extends transversely to the path of the boxes and which is connected to said proximal belt support frame, said second horizontal shaft having one end to which said hinged lug is fixed, c) a displacement means operatively connected to said main shaft for moving said second horizontal shaft (i) axially in a reciprocating manner between a retracted position where said second horizontal shaft does not interfere with the movement of the boxes and, after a box has passed thereby and stopped, an extended position behind the stopped box, and (ii) rotationally between an open position beneath the rear top flap of the stopped box and a folded position where the rear top flap is folded closed onto the box opening, the closed position being maintained as the box is subsequently moved forward to hold the rear top flat in the folded closed position; and d) a fixed folding member which interferes with front top flap as the stopped box is subsequently moved to fold the front top flap on top of the rear top flap which is held by said displacement means.

13. (21) A rectilinear box opening and filling machine as claimed in claim 12: wherein said second closing means further includes a) a small splined shaft forming said second horizontal shaft, b) a splined bush which is engaged by said small splined shaft and which is externally toothed, c) a second support container which rotatably supports said splined bush, d) a rack which tangentially meshes with said splined bush, e) a sixth lever to which said rack is connected, f) a first vertical descending shaft having a top end to which said sixth lever is keyed, g) a flanged wheel provided on said small splined shaft, h) a seventh lever having an end roller which engages said flanged wheel, i) a second vertical descending shaft having a top end to which said seventh lever is keyed, j) a fixed housing in which bottom ends of said first and second vertical descending shafts are rotatably supported, k) first and second eccentric rollers in said fixed housing attached respectively to said first and second descending shafts, l) a third horizontal shaft which extends from said fixed housing into said third casing having first and second helical profile cams which are respectively engaged by said first and second eccentric rollers, and m) a bevel gear pair operatively connecting said main shaft to said third horizontal shaft.

14. (1+2+13) A rectilinear box opening and filling machine for processing vertically arranged boxes, comprising:

a modular base having a plurality of operating stations;

a main shaft longitudinally arranged inside of said modular base by which said operating stations operate;

a plurality of upturned portal stations cantilevered to one side of said modular base, said one side defining proximal and distal relationships;

a vertical belt conveyor including a) proximal and distal pairs of parallel, vertical-axis, toothed belts which convey a vertically arranged box therebetween, and b) proximal and distal horizontal belt-support frames which are attached to said plurality of portal stations and which respectively support said proximal and distal pairs of toothed belts;

wherein at least one of said operating stations is supported by one of said belt-support frames such that underneath of all of said belt-support frames an unoccupied space is provided which allows for a fast removal of dirt which falls from above said belt-support frames and which allows accessibility to said at least one of said operating stations, said toothed belts, and said belt-support frames;

wherein said modular base has first, second and third module casings which are arranged one after another and fixed together;

wherein said first casing includes a) a magazine which feeds the boxes individually, and b) a first closing means and for closing bottom flaps of each box received from said magazine;

wherein said second casing includes an insertion means for inserting a product into an open top of each box;

wherein said third casing includes a second closing means for closing top flaps of each box;

wherein said first and second closing means are each include a respective folding means for folding an outermost closing flat and attached end tongue, each said folding means including a) an adjustable end means for folding the end tongue by more than 90° in a direction towards the box, and b) an adjustable comb means for folding the outermost closing flap into a closed position while guiding the associated end tongue into the box.

15. (14) A rectilinear box opening and filling machine as claimed in claim 14:

wherein each said adjustable end means includes a) a hook-shaped member having a working hook end positioned to receive the end tongue such that a hook edge of said hook end is located in contact with and parallel to a joining line of the outermost closing flap and associated end tongue, b) a slide to which said hook-shaped member is fixed at an inclined angle to the box, c) a fixed guide extending vertically on which said slide is adjustably positioned to properly position said hook end for a predetermined size of box desired, d) a vertical and splined shaft rotatably supported by said fixed guide, e) bevel gear pair connected to a bottom of said splined shaft, f) a gear wheel located in an associated said casing which is connected to said bevel gear pair and having an eccentric roller, g) a cam keyed to said main shaft and having a profile in which said eccentric roller is located such that an oscillating motion is transmitted to said splined shaft, h) an inclined-tooth rack having a cross-piece at a free end thereof, and i) a seat in said slide in which said rack is (i) guided for movement and for engagement with said splined shaft such that said rack is moved in a reciprocating rectilinearly movement by rotation of said splined shaft, (ii) oriented in a direction of the box, (iii) mounted parallel to a body of said hook-shaped member, (iv) positioned with said cross-piece in position to fold the end tongue over said hook edge when said rack is moved rectilinearly.

16. (15) A rectilinear box opening and filling machine as claimed in claim 15:

wherein each said adjustable comb means includes a) a first comb having first teeth which is (i) oriented upwards in a rest position, (ii) positioned laterally with respect to the associated outermost closing flap to be closed, and (iii) hinged on an axis parallel to a direction of travel of the boxes, b) a second comb having tapered second teeth (i) arranged between said first teeth, (ii) oriented in the direction of the boxes, and (iii) forming with the first teeth an internal angle of less than 90°, c) a comb structure (i) to which said second teeth are attached which is adjustable along a position parallel to said first teeth such that a position of said second teeth from the hinge axis of said first comb is adjustable according to a predetermined size of the boxes, and (ii) which pivots about an axis situated after and aligned with the hinge axis of said first comb, d) a pivoting means for pivoting said first and second combs simultaneously such that said first comb folds the outermost closing flap as said second comb holds the end tongue at the folded position and such that prior to entry of the end tongue in the box the tapered second teeth of said second comb enter the box and stop at a substantially vertical orientation before the end tongue enters the box as said first comb continues to pivot and move the outermost closing flap to the closed position as said second teeth guide the end tongue into the box.

17. (16) A rectilinear box opening and filling machine as claimed in claim 16:

wherein each said adjustable comb means further includes a) a first radial lug attached to a proximal end of said first comb adjacent to the hinge axis, b) a first roller mounted to said first radial lug, c) a first linear cam (i) having a first profile in which said first roller moves and being positioned parallel to the direction of travel of the boxes, said first profile being a segment of a circle with a center of curvature on the hinge axis, d) a second radial lug attached to said comb structure adjacent to the pivot axis, e) a second roller mounted to said second radial lug, f) a second linear cam (i) having a second profile in which said second roller moves and being positioned parallel to the direction of travel of the boxes, said second profile being a segment of a circle with a center of curvature on the pivot axis, g) a parallel slide mounted for reciprocating movement parallel to said hinge and pivot axes and on which said first and second cams are located, h) a comb rack attached to said parallel slide, and i) a comb pinion which meshes with said comb rack and which is keyed to said splined shaft.

18. (17) A rectilinear box opening and filling machine as claimed in claim 16:

wherein each said adjustable comb means further includes a pressing device adjustably mounted to said comb structure downstream of said second teeth such that said pressing device presses the outermost closing flap to push the end tongue completely into the associated box.

19. (18) A rectilinear box opening and filling machine as claimed in claim 16:

wherein said first closing means further includes a guiding and opposing means which engages an inner side of the top outermost closing flap for preventing the associated box from vertical displacement during folding of the bottom outermost closing flap.

* * * * *